US006908014B1

(12) United States Patent
Glover

(10) Patent No.: US 6,908,014 B1
(45) Date of Patent: Jun. 21, 2005

(54) ANTI-THEFT PROTECTIVE COVER

(76) Inventor: George Glover, 18395 Mason Smith Rd., Brooksville, FL (US) 34601

( * ) Notice: Subject to any disclaimer, the term of this patent is extended or adjusted under 35 U.S.C. 154(b) by 62 days.

(21) Appl. No.: 10/604,675

(22) Filed: Aug. 8, 2003

(51) Int. Cl.[7] ..... B67D 5/32
(52) U.S. Cl. ..... 222/153.1; 222/153.09; 222/71; 222/75
(58) Field of Search ..... 222/71, 74, 75, 222/153.09, 153.1

(56) References Cited

U.S. PATENT DOCUMENTS 1,776,226 A * 9/1930 Nelson et al. ..... 222/153.03
3,845,848 A * 11/1974 Robbins ..... 194/206
4,101,056 A * 7/1978 Mattimoe et al. ..... 222/26
4,186,850 A * 2/1980 Mahar ..... 222/28
4,195,674 A * 4/1980 Madden ..... 141/392
6,311,739 B1 * 11/2001 Thompson et al. ..... 141/94

* cited by examiner

*Primary Examiner*—Joseph A. Kaufman
(74) *Attorney, Agent, or Firm*—Ronald E. Smith; Smith & Hopen, P.A.

(57) ABSTRACT

An anti-theft device prevents tampering with a diesel fuel dispenser. The device bars access to a pulser even if a cover of the dispenser is pried back or removed. A housing formed of plate steel substantially surrounds the pulser and is secured to the frame of the dispenser in three places so that about one-half hour is required to remove the device, even after a cover has been fully removed from the dispenser. This allows ample time for a station operator to observe that a theft is in progress. Three bolts are used to secure the device to the frame of the dispenser. Advantageously, all three of the bolts are placed into pre-existing openings so that no new openings need to be drilled as a part of the installation process. Only one pre-existing bolt of the frame is removed and reinstalled during the installation procedure.

9 Claims, 4 Drawing Sheets

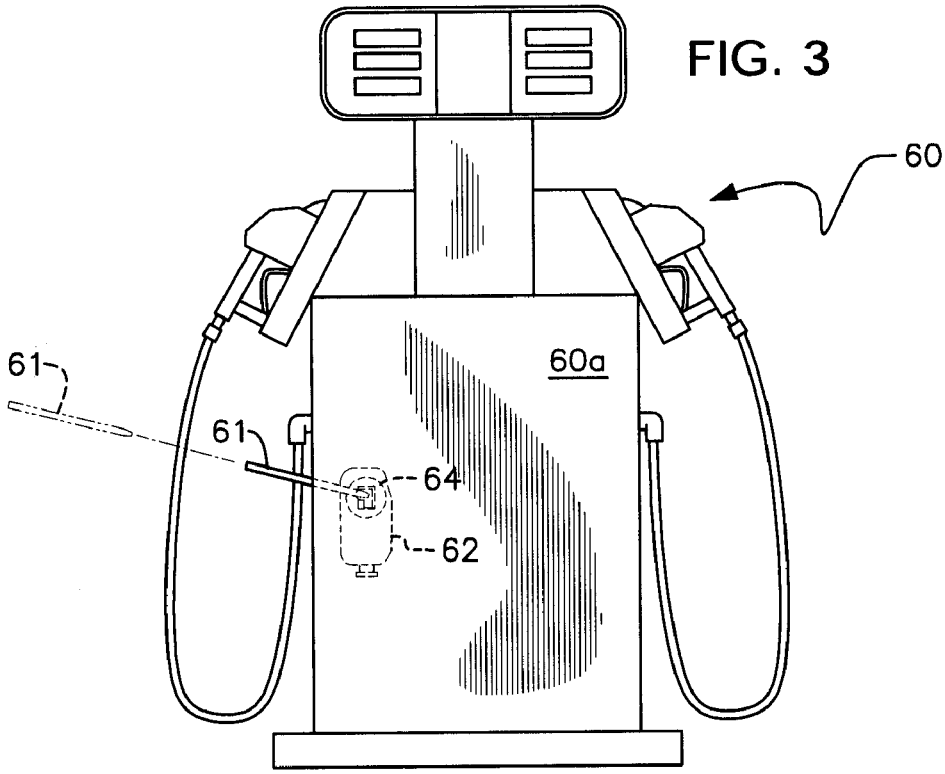
FIG. 3
FIG. 4
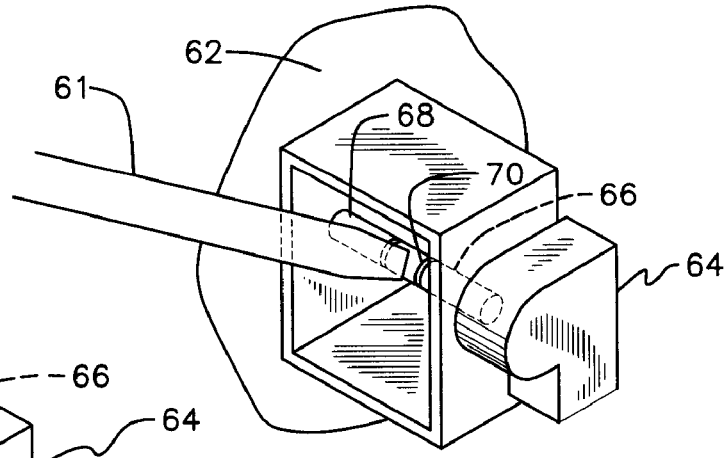
FIG. 5
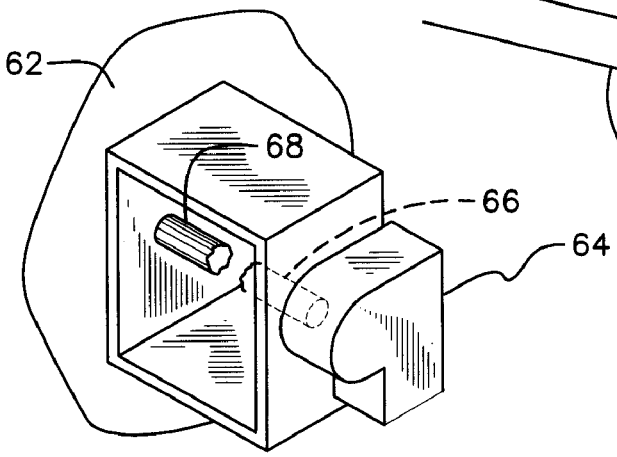

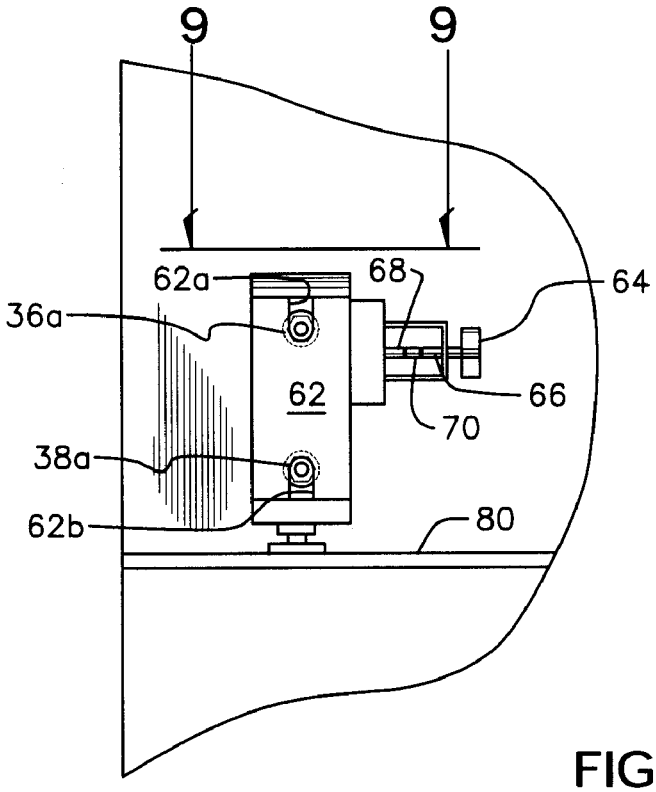
FIG. 8
FIG. 9
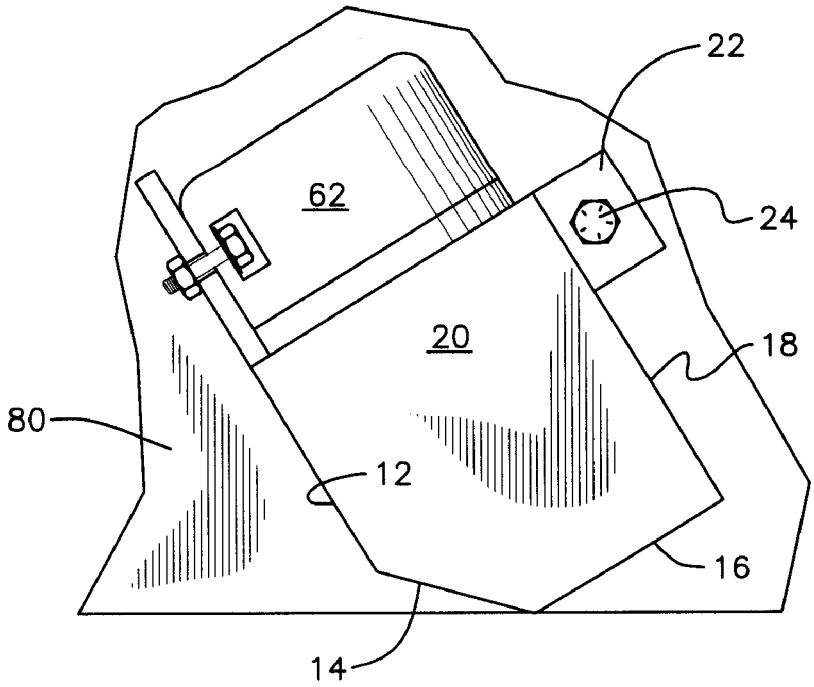

ANTI-THEFT PROTECTIVE COVER

BACKGROUND OF INVENTION

1. Field of the Invention

This invention relates, generally, to anti-theft devices. More particularly, it relates to a device that prevents theft of diesel fuel from diesel fuel dispensers.

2. Description of the Prior Art

A thief can steal diesel fuel from a diesel fuel dispenser by using a crowbar or other suitable implement to pry back a cover of the dispenser a short distance and to insert the same implement, or another implement, into the hollow interior of the dispenser to disable a pulser. The function of the pulser is to generate electrical signals that report the amount of fuel consumed to the electronics of the dispenser so that the quantity and price of dispensed fuel may be displayed to the consumer.

The liquid control meter of the dispenser continues to operate when the pulser is disabled and diesel fuel is delivered to the consumer. However, the fluid flow is not detected by the disabled pulser. An attendant monitoring a computer screen that receives information from the pulser will be unaware that fuel is being dispensed.

Since theft is so easy when a pulser is unprotected, the station attendant is unaware that a theft has occurred until an honest trucker reports that a dispenser is dispensing free fuel. By then, several of the initial thief's friends and others willing to take advantage of the broken dispenser may have filled their respective saddle tanks.

Most gasoline theft is committed by people who fill their car's tank and drive off without paying, secure in the knowledge that law enforcement authorities have little time available to search for and apprehend such thieves. Since such theft is relatively uncommon, and since the amount of fuel stolen per incident is considered to be a nominal amount by the industry, not much attention has been paid to ways to stop such theft.

However, large trucks are equipped with gas tanks known as saddle tanks that can hold two to three hundred gallons of diesel fuel. Drive off theft of diesel fuel is rare because trucks accelerate slowly and a station owner has plenty of time to write down a license plate number. Due to the large scale of such a theft, law enforcement authorities will search for and apprehend such thieves.

Thieves have therefore designed new ways to get free diesel fuel. The most widely spread technique is to pry back a cover of the diesel fuel dispenser, commonly known as a fuel pump, and disable the pulser. A pulser counts the revolutions of a liquid control meter and includes a coupler that interconnects the dispenser's liquid control meter and the pulser. When the liquid control meter and the pulser are decoupled from one another, fuel continues to flow but no electrical signal indicating such flow is generated, and a thief may drive off without attracting attention because no sale will have registered on the dispenser or on the remote monitor that is watched by an attendant. Accordingly, after prying back the cover of a diesel fuel dispenser, the thief uses a suitable tool to poke the coupler. The coupler is not designed to withstand such an attack and it is relatively easy to knock out of its functional position. With the coupler knocked out of place, the liquid control meter is no longer coupled to the pulser and fuel is dispensed without detection.

Several attempts have been made in an effort to stop this type of theft. A large metal band is sometimes wrapped around the dispenser in an effort to prevent prying away of the cover. The bands quickly stretch and loosen, however, enabling thieves to pry back the cover without any problem. Some thieves simply cut off such bands if they are encountered.

Another attempt includes the impaling of the dispenser with a large bolt that extends from the front cover to the rear cover. Although this makes complete removal of the covers difficult, it does little to prevent a thief from prying back a corner of the cover to expose the internal workings of the dispenser. The amount of prying required is nominal a pencil width crack is all that is needed to expose the pulser and its vulnerable coupler.

The manufacturers of dispensers could solve the problem by re-designing the dispensers, but such re-designing would require a huge investment. Nor is it obvious as to what form such re-designing would take, i.e., inventive effort would be required in such re-designing. Redesigning and replacing the thousands of diesel fuel pumps in use throughout the world is simply not a cost-effective option.

A more suitable solution would be a low cost device that could be retrofit onto existing dispensers.

However, in view of the prior art considered as a whole at the time the present invention was made, it was not obvious to those of ordinary skill in the pertinent art how such a device could be provided.

SUMMARY OF INVENTION

The long-standing but heretofore unfulfilled need for a device that prevents theft of diesel fuel from diesel fuel dispensers is now met by a new, useful, and nonobvious invention.

An important object of this invention is to provide an anti-theft device that prevents thieves from stealing diesel fuel from diesel fuel dispensers.

A more specific object is to provide an anti-theft device that may be retrofit onto existing diesel fuel dispensers.

An even more specific object it to provide an anti-theft device made of inexpensive materials, which is easy to install but difficult to remove.

These and other important objects, advantages, and features of the invention will become clear as this description proceeds.

The invention accordingly comprises the features of construction, combination of elements, and arrangement of parts that will be exemplified in the description set forth hereinafter and the scope of the invention will be indicated in the claims.

BRIEF DESCRIPTION OF DRAWINGS

For a fuller understanding of the nature and objects of the invention, reference should be made to the following detailed description, taken in connection with the accompanying drawings, in which:

FIG. 3 is a front elevational view of a diesel fuel dispenser including a liquid control meter and pulser in phantom lines;

FIG. 4 is a perspective view depicting a pulser and an implement used to disable the pulser;

FIG. 5 is a perspective view depicting a disabled pulser;

FIG. 8 is a view taken along line 8—8 in FIG. 6; and

FIG. 9 is a view taken along line 9—9 in FIG. 8.

DETAILED DESCRIPTION

Figure 1:
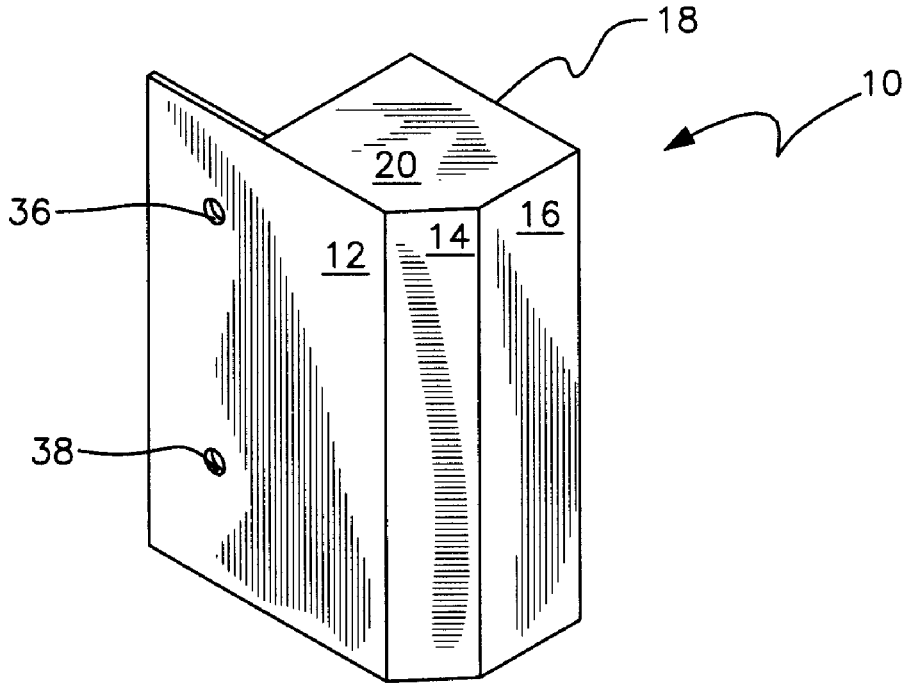
FIG. 1 is a front perspective view of the novel apparatus.
Figure 2:
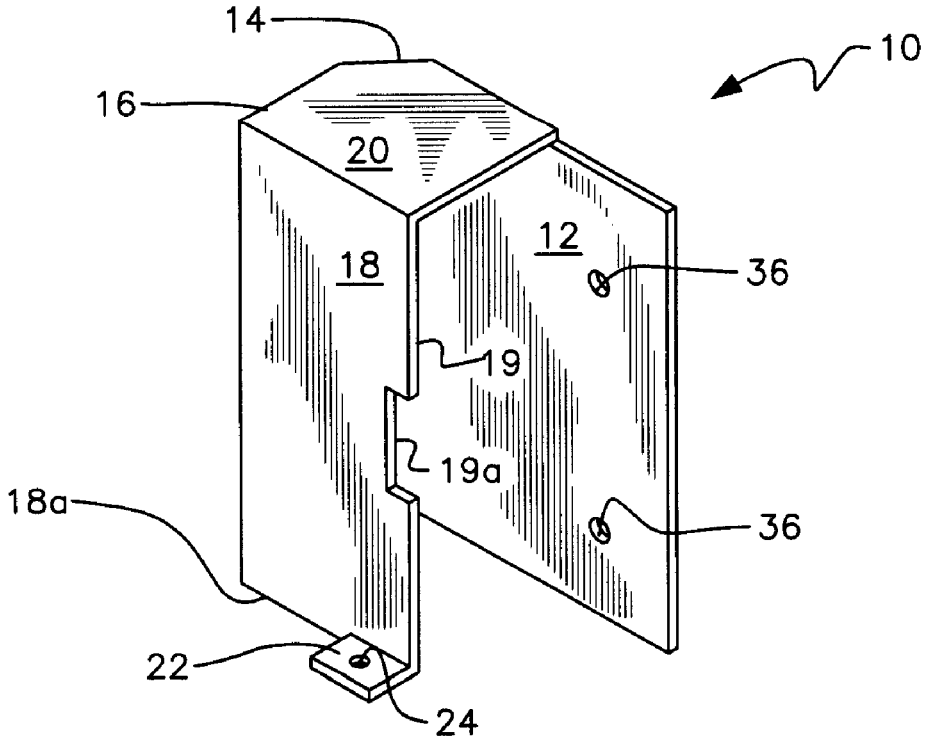
FIG. 2 is a rear perspective view of said novel apparatus.

Referring to FIGS. 1 and 2, it will there be seen that the reference numeral 10 denotes an illustrative embodiment of the present invention as a whole.

Anti-theft device 10 includes first side wall 12, angled wall 14, front wall 16, second side wall 18, end wall 20, and tab 22. Rectangular opening 19*a* is in open communication with rear edge 19 of first side wall 12, substantially centrally thereof.

The extent of first side wall 12 is about twice the extent of second side wall 18 and the extent of end wall 20 is substantially equal to the extent of second side wall 18. First side wall 12 is substantially parallel to second side wall 18. Angled wall 14 is positioned at a substantially forty five degree (45°) angle relative to first side wall 12 and front wall 16.

Tab 22 is fixedly secured to or formed integrally with second side wall 12 at an end thereof opposite from end wall 20 and is centrally apertured as at 24. Tab 22 is positioned in perpendicular relation to second side wall 18 at the rearward end of the lower edge 18*a* of said second side wall 18.

Anti-theft device 10 is preferably formed of plate steel but other suitable materials are within the scope of this invention. The materials should be at least twelve (12) gauge.

Having disclosed the structure of the novel anti-theft device, its installation to a diesel dispenser may now be described with reference to FIGS. 3–9.

Diesel dispenser 60 includes a front cover 60*a* and a back cover, not depicted, of the same construction. Neither of these covers is particularly strong and a crowbar or other suitable instrument may be employed to pry either cover away from the frame of dispenser 60. In other words, covers 60*a* and 60*b* are primarily provided for aesthetic reasons and are not built to deter thieves from breaking into the essentially hollow interior of the fuel dispenser.

FIG. 3 depicts how a single implement 61 may be used to pry open cover 60*a* and to disable the part of dispenser 60 that measures and reports the amount of fuel being dispensed. Two separate implements may also be used, one to pry open cover 60*a* and another to disable said part.

More particularly, FIG. 3 depicts, in phantom lines, liquid control meter 62 and pulser 64 that are mounted within the hollow interior of dispenser 60. When fuel is being dispensed, said fuel flows through liquid control meter 62 and causes rotor blades that form a part of the liquid control meter to rotate about an axis of rotation. Pulser 64 includes a suitable means for counting the blades of the liquid control meter as they rotate. For example, if the liquid control meter contains six rotor blades, the pulser counts one revolution of the liquid control meter for each sixth blade that rotates past it. The volume of diesel fuel that must flow through the liquid control meter to cause one revolution thereof is known so in this way the amount of diesel fuel dispensed can be computed.

Rectangular slot 19*a* (FIG. 2) accommodates a protrusion of the type commonly formed in a typical liquid control meter 62.

As depicted in FIG. 4, pulser shaft 66 forms a part of pulser 64 and liquid control meter shaft 68 forms a part of liquid control meter 62. Coupler 70 joins together pulser shaft 66 and liquid control meter shaft 68 so that said shafts rotate conjointly with one another.

A knowledgeable thief can steal diesel fuel by prying cover 60*a* slightly away from its frame with a suitable implement 61, followed by using the same implement or another tool to push coupler 70 out of its position so that pulser shaft 66 and liquid control meter shaft 68 are no longer coupled to one another. FIG. 5 depicts pulser shaft 66 and liquid control meter shaft 68 when coupler 70 has been removed.

When coupler 70 is no longer performing its shaft-coupling function, fuel is dispensed the normal way and flows through liquid control meter 62 in the normal way, but pulser shaft 66 does not rotate and pulser 64 therefore sends no signals to the electronics of the dispenser. Thus, no price of fuel is generated and displayed to the consumer or to a station attendant by the dispenser electronics because said electronics receives no signals indicating that fuel is being dispensed.

Figure 6:
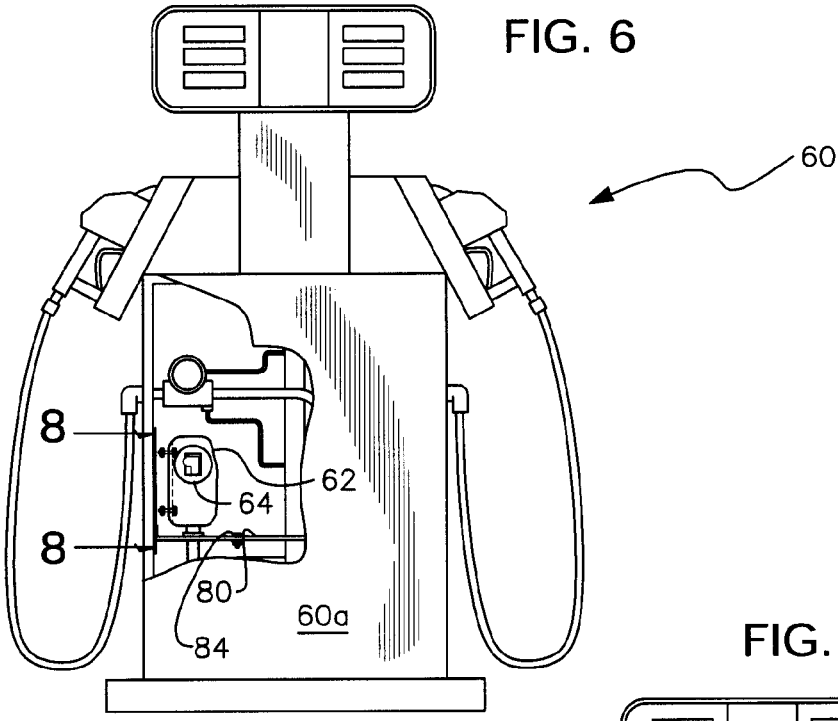
FIG. 6 is a front elevational view like FIG. 1 but having a cut-away to show an unprotected pulser.

Anti-theft device 10 is formed of plate steel that shields pulser 64 and hence coupler 70 so that said coupler cannot be knocked out of position by a tool, even if cover 60*a* is completely removed from dispenser 60. The cut-away view of FIG. 6 depicts an unprotected pulser and the cutaway view of FIG. 7 depicts a protected or shielded pulser.

Anti-theft device 10 is specifically constructed so that it takes advantage of the pre-existing structural features of dispenser 60.

Specifically, as perhaps best understood in connection with FIGS. 8 and 9, liquid control meter 62 is supported by flat support plate 80 that is supported by a pair of parallel frame members, not depicted, that form a part of the dispenser frame.

Figure 7:
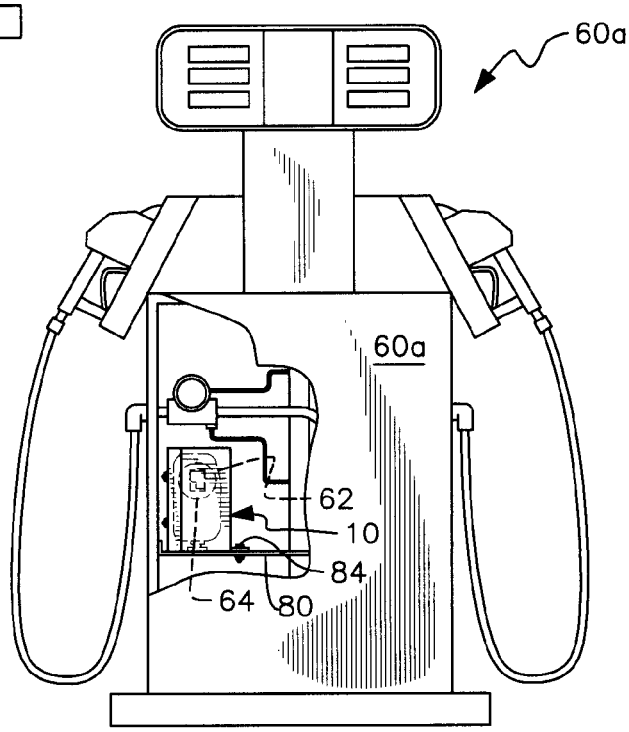
FIG. 7 is a front elevational view like FIG. 4 but having a cut-away to show a pulser protected by the inventive protector.

As depicted in FIG. 7, screw 84 secures support plate 80 to a first frame member of the two unillustrated frame members and another screw secures said support plate 80 to a second frame member of said two unillustrated frame members.

To install anti-theft device 10, screw 84 is removed and any electrical wiring and small piping extending from liquid control meter 62 to the dispenser electronics, not shown, is moved out of the way as needed so that opening 24 formed in tab 22 (FIG. 2) may be placed into alignment with the opening in support plate 80 made available by the removal of screw 84. Tab 22 is placed into overlying relation to support plate 80 with opening 24 formed in tab 22 in alignment with said available opening screw 84 is reinstalled. Suitable washers, a lock washer and a nut are used to secure said screw in a well-known way.

As depicted in FIG. 8, opposing open-ended slots 62*a*, 62*b* are formed in liquid control meter 62 by its manufacturer. Openings 36 and 38 (FIGS. 1 and 2) are formed in first side wall 12 in laterally spaced relation to one another. Opening 36 is adapted to receive bolt 36*a* and opening 38 is adapted to receive bolt 38*a*. When tab 22 is installed in the manner described above, openings 36 and 38 are in alignment with slots 62*a*, 62*b*, respectively. Bolts 36*a*, 38*a* extend through slots 62*a*, 62*b* and through openings 36, 38 to secure device 10 to liquid control meter 62. Suitable washers, lock washers, and nuts are used to complete the engagement in a well-known way.

Thus, anti-theft device 10 is secured to liquid control meter 62 in two locations and to support plate 80 as well. All three of these locations are hard to reach and it takes about half an hour to remove cover 60*a* completely from dispenser 60 to provide access to the three screws and to remove all three of them. None of the three screws can be removed if the thief merely pries cover 60*a* back with respect to its frame.

This thirty minute interval compares advantageously with the fifteen seconds or so that it takes to pry back cover 60*a* a short distance and to poke out coupler 70. Thus, a station attendant has almost no opportunity to discover a thief in action when a dispenser 60 is not equipped with anti-theft device 10 but said station attendant has ample opportunity to notice anyone who removes cover 60*a* completely and works on dispenser 60 for half an hour or so.

It will thus be seen that the objects set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

Now that the invention has been described,

What is claimed is:

1. An anti-theft device that protects from tampering a fuel dispenser of the type containing a liquid control meter and a pulser, comprising:

a substantially impenetrable protective cover that substantially surrounds and bars access to said pulser;

said protective cover being fixedly secured to a pre-existing frame of said dispenser;

said protective cover, when in an installed configuration, having a first side wall adapted to be fixedly secured to a liquid control meter, a front wall, an angled wall that interconnects said first side wall and said front wall, a second side wall, and end wall, and a tab;

said first side wall being disposed substantially parallel to said second side wall; and said angled wall being positioned at a substantially forty five degree (45°) angle relative to said first side wall and said front wall.

2. The anti-theft device of claim 1, further comprising:

a rectangular slot formed in open communication with an edge of said first side wall, substantially centrally thereof, to accommodate said liquid control meter.

3. The anti-theft device of claim 1, further comprising:

said first side wall having an extent equal to about twice the extent of said second side wall.

4. The anti-theft device of claim 1, further comprising:

said end wall having an extent substantially equal to the extent of said second side wall.

5. The anti-theft device of claim 1, further comprising:

said tab being fixedly secured to said second side wall at an end thereof opposite from said end wall.

6. The anti-theft device of claim 1, said tab being positioned in perpendicular relation to said second side wall.

7. The anti-theft device of claim 6, further comprising:

a lowermost edge of said tab being substantially coincident with a lowermost edge of said second side wall.

8. The anti-theft device of claim 1, further comprising:

said tab being fixedly secured to a support plate that forms a part of said frame of said dispenser;

said support plate supporting said liquid control meter; and said liquid control meter being fixedly secured to said support plate.

9. The anti-theft device of claim 8, further comprising;

said first side wall of said device being fixedly secured to said liquid control meter.

* * * * *